US006684431B2

(12) United States Patent
Splane, Jr.

(10) Patent No.: US 6,684,431 B2
(45) Date of Patent: Feb. 3, 2004

(54) ANGLE-ADJUSTABLE TABLETOP PERSONAL SUPPORT APPARATUS

(75) Inventor: Robson L. Splane, Jr., Granada Hills, CA (US)

(73) Assignee: LifeGear, Inc., El Monte, CA (US)

( * ) Notice: Subject to any disclaimer, the term of this patent is extended or adjusted under 35 U.S.C. 154(b) by 85 days.

(21) Appl. No.: 10/007,847

(22) Filed: Nov. 5, 2001

(65) Prior Publication Data

US 2003/0084513 A1 May 8, 2003

(51) Int. Cl.[7] ..... A47C 20/04

(52) U.S. Cl. ..... 5/657; 5/638; 5/640; 248/118

(58) Field of Search ..... 5/657, 632, 630, 5/634, 636, 638, 640, 643, 622; 248/118, 118.3, 118.5

(56) References Cited

U.S. PATENT DOCUMENTS

| | | | | | |
|---|---|---|---|---|---|
| 39,462 | A | * | 8/1863 | Brown | 5/634 |
| 224,272 | A | * | 2/1880 | Buell | 297/118 |
| 238,780 | A | * | 3/1881 | Hopkins et al. | 5/634 |
| 306,590 | A | * | 10/1884 | Davis | 5/622 |
| 309,678 | A | * | 12/1884 | Aubin | 5/622 X |
| 319,537 | A | * | 6/1885 | Winter | 5/640 X |
| 579,660 | A | * | 3/1897 | Williamson et al. | 5/634 |
| 839,755 | A | * | 12/1906 | Harper, Jr. | 5/622 X |
| 858,908 | A | * | 7/1907 | Rauch | 5/640 X |
| 966,637 | A | * | 8/1910 | Akin | 5/634 |
| 969,099 | A | * | 8/1910 | Fuchs | 5/634 |
| 989,888 | A | * | 4/1911 | Adler | 5/634 |
| 1,103,730 | A | * | 7/1914 | Anderson | 5/634 |
| 1,151,894 | A | * | 8/1915 | Meinecke | 5/634 |
| 1,281,074 | A | * | 10/1918 | Russell | 5/634 |
| 1,297,088 | A | * | 3/1919 | Butler | 5/634 |
| 1,515,886 | A | * | 11/1924 | Rumsey | 5/640 X |
| 1,632,160 | A | * | 6/1927 | Barnes | 27/13 |
| 2,133,223 | A | * | 10/1938 | Brightman et al. | 5/634 |
| 2,208,945 | A | * | 7/1940 | Miller | 297/170 |
| 2,250,026 | A | * | 7/1941 | Laukhuff | 5/634 |
| 2,614,271 | A | * | 10/1952 | Neil | 5/640 |
| 2,663,029 | A | * | 12/1953 | Whitley et al. | 5/640 X |
| 2,817,857 | A | * | 12/1957 | Hockensmith | 5/643 X |
| 3,337,883 | A | * | 8/1967 | Allison | 5/638 |
| 3,366,106 | A | * | 1/1968 | Yao et al. | 5/638 X |
| 3,452,372 | A | * | 7/1969 | Emery | 5/632 X |
| 3,484,878 | A | * | 12/1969 | Nielsen | 5/622 X |
| 3,808,615 | A | * | 5/1974 | Geary | 5/622 |
| 4,074,374 | A | * | 2/1978 | Ayesh | 5/622 X |
| 4,504,050 | A | * | 3/1985 | Osborne | 5/640 X |
| 4,660,237 | A | * | 4/1987 | Brodnax | 5/636 |
| 4,752,064 | A | * | 6/1988 | Voss | 5/638 |
| 5,160,185 | A | * | 11/1992 | Stang | 297/377 |
| 5,165,137 | A | * | 11/1992 | Amrein et al. | 5/640 |
| D337,914 | S | * | 8/1993 | McDonald | 5/638 X |
| 6,112,333 | A | * | 9/2000 | Mazzei | 5/638 X |
| 6,154,903 | A | * | 12/2000 | Wai-Chung | 5/657 X |
| 6,374,441 | B1 | * | 4/2002 | Begell | 5/638 |
| 6,490,737 | B1 | * | 12/2002 | Mazzei et al. | 5/638 X |
| 2002/0100846 | A1 | * | 8/2002 | Tinsley | 248/118 |
| 2003/0084513 | A1 | * | 5/2003 | Splane, Jr. | 5/657 |

FOREIGN PATENT DOCUMENTS

| | | | | |
|---|---|---|---|---|
| CH | 82573 B | * | 10/1919 | 5/634 |
| FR | 1474119 A | * | 2/1967 | 5/634 |

* cited by examiner

*Primary Examiner*—Robert G. Santos
(74) *Attorney, Agent, or Firm*—David L. Davis

(57) ABSTRACT

An angle-adjustable tabletop personal support apparatus includes a positioning base for positioning on the top of a table, a supporting mattress unit pivoted to the positioning base and adapted to support the user's head and chest, and an angle adjustment unit provided between the positioning base and the supporting mattress unit and adapted to support the supporting mattress unit on the positioning base in a tilted position.

5 Claims, 5 Drawing Sheets

ANGLE-ADJUSTABLE TABLETOP PERSONAL SUPPORT APPARATUS

BACKGROUND OF THE INVENTION

The present invention relates to a support for a user's head, chest and arms and, more particularly, to an angle-adjustable tabletop personal support apparatus, which can be positioned on the top of a table to support the head, chest and arms of the user when taking an afternoon nap or having an upper body massage.

When having an upper body massage or taking an afternoon nap in the office, a person may rest his/her head on his/her crossed hands on top of a table or desk. Being positioned in this manner may cause problems as outlined hereinafter.

1. When resting the head on crossed hands on top of the table, a stress is produced and given to the abdomen, affecting the functioning of the digestive organs.
2. When resting the head on crossed hands on top of the table, the pressure of the head affects the circulation of blood through the hands, and the joints of the hands may ache.
3. Being positioned in this manner cannot help people to restore strength of the body.

Due to the aforesaid drawbacks, people cannot quickly restore strength after taking a nap. If one cannot rest after working for a long time in front of a computer, the muscles of the neck and the back may ache. Further, it is inconvenient for disabled people or people in a wheelchair to move to a bed or massage table in order to rest or to have an upper body massage.

SUMMARY OF THE INVENTION

The present invention has been accomplished under the circumstances in view. It is one object of the present invention to provide an angle-adjustable tabletop personal support apparatus, which supports the head, chest and arms of the user comfortably when the user takes a nap or has an upper body massage in a limited room space. To achieve this and other objects of the present invention, the angle-adjustable tabletop personal support apparatus comprises a positioning base for positioning on the top of a table, a supporting mattress unit pivoted to the positioning base and adapted to support the user's head and chest, and an angle adjustment unit provided between the positioning base and the supporting mattress unit and adapted to support the supporting mattress unit on the positioning base in a tilted position.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
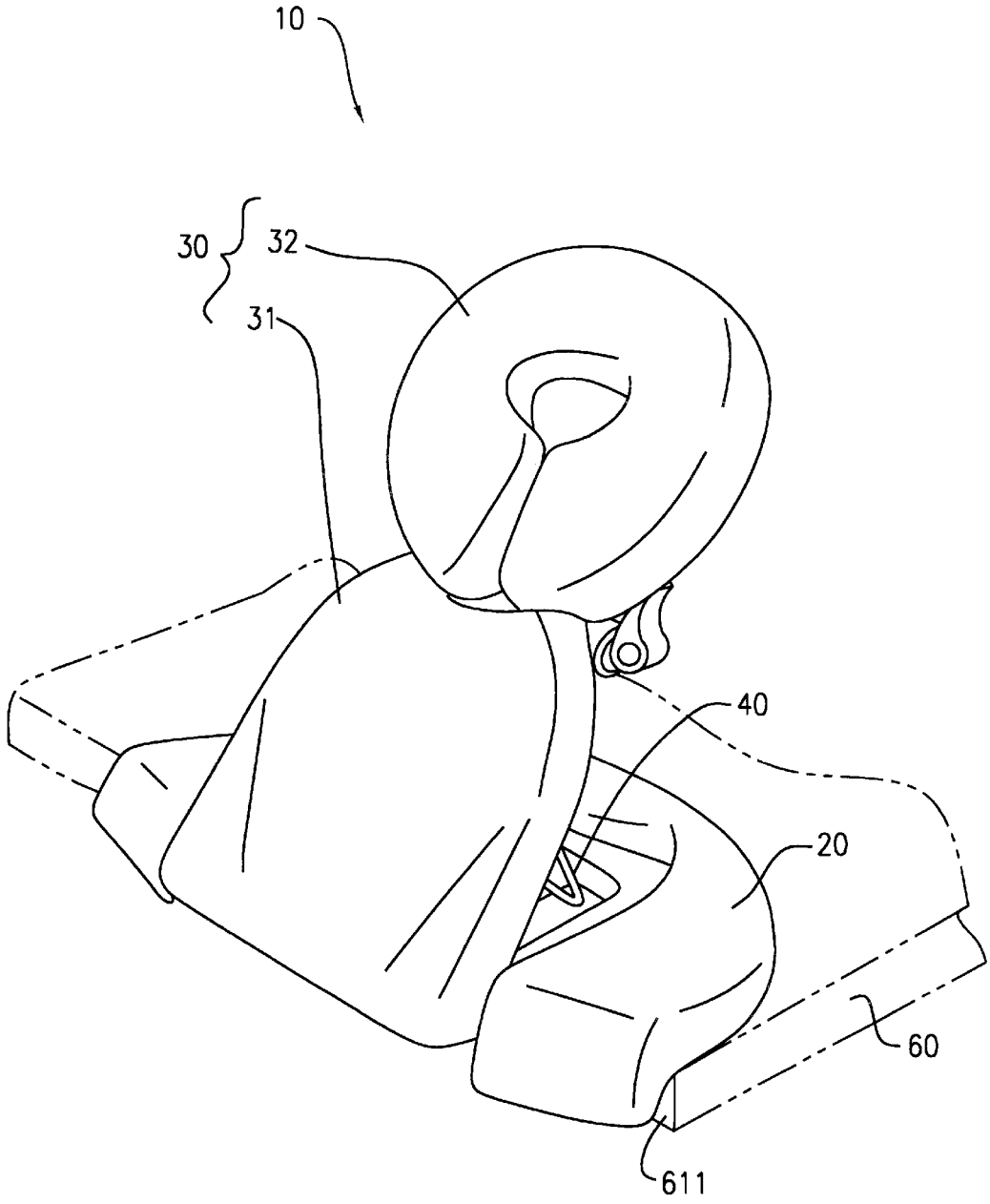
FIG. 1 is a perspective view of an angle-adjustable tabletop personal support apparatus according to the present invention.

Referring to FIG. 1, an angle-adjustable tabletop personal support apparatus 10 is shown comprised of a positioning base 20, a supporting mattress unit 30, and an angle adjustment unit 40.

Figure 2B:
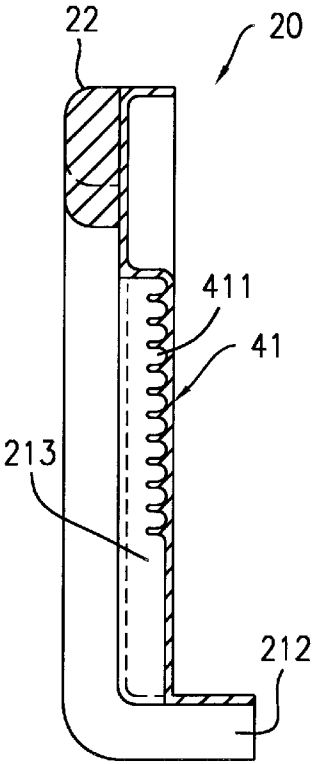
FIG. 2B is a partially sectioned end view of the positioning base of the angle-adjustable tabletop personal support apparatus shown in FIG. 1.
Figure 2A:
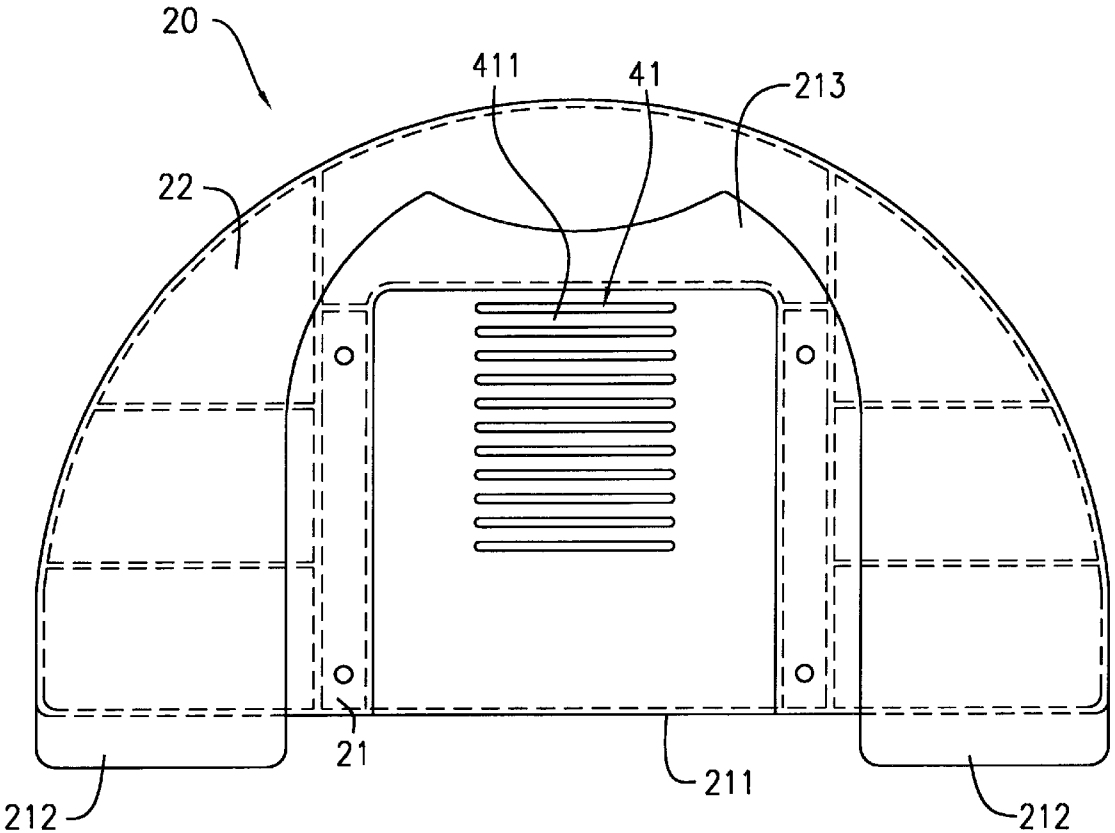
FIG. 2A is a plan view of the positioning base of the angle-adjustable tabletop personal support apparatus shown in FIG. 1.

Referring to FIGS. 2A and 2B, the positioning base 20 comprises a base frame 21 and a bearing mattress 22. The base frame 21 is a flat semicircular frame having a straight peripheral side 211 and two positioning portions 212 bilaterally perpendicularly extending from the straight periphery side 211 and arranged in parallel. The bearing mattress 22 is a soft member stuffed with molded foam or any of a variety of soft materials and fixedly mounted on the base frame 21 along the border of the base frame 21, defining with the base frame 21 a recessed receiving portion 213.

Figure 3:
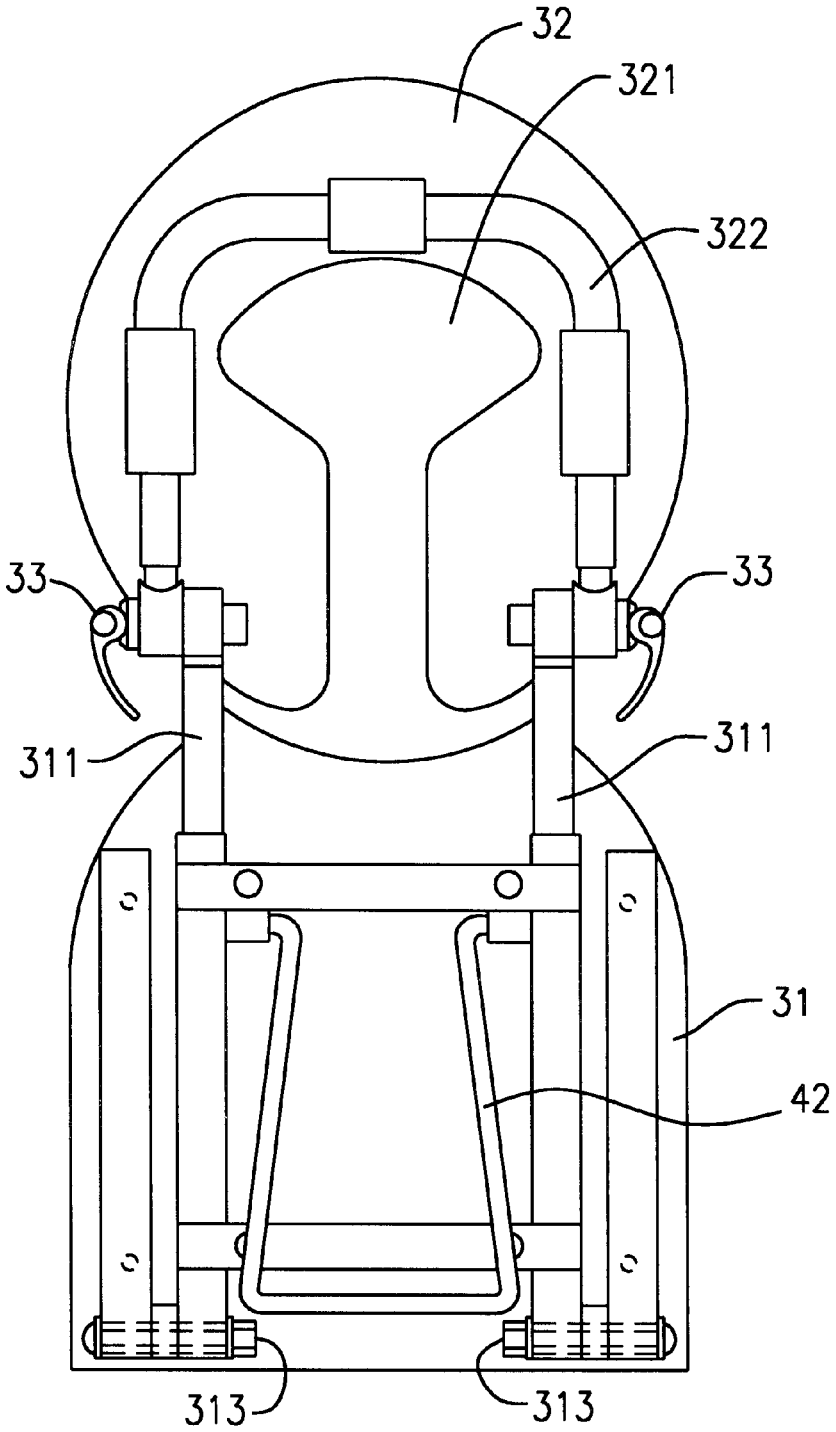
FIG. 3 is a bottom view of a portion of the angle-adjustable tabletop personal support apparatus shown in FIG. 1.
Figure 4:
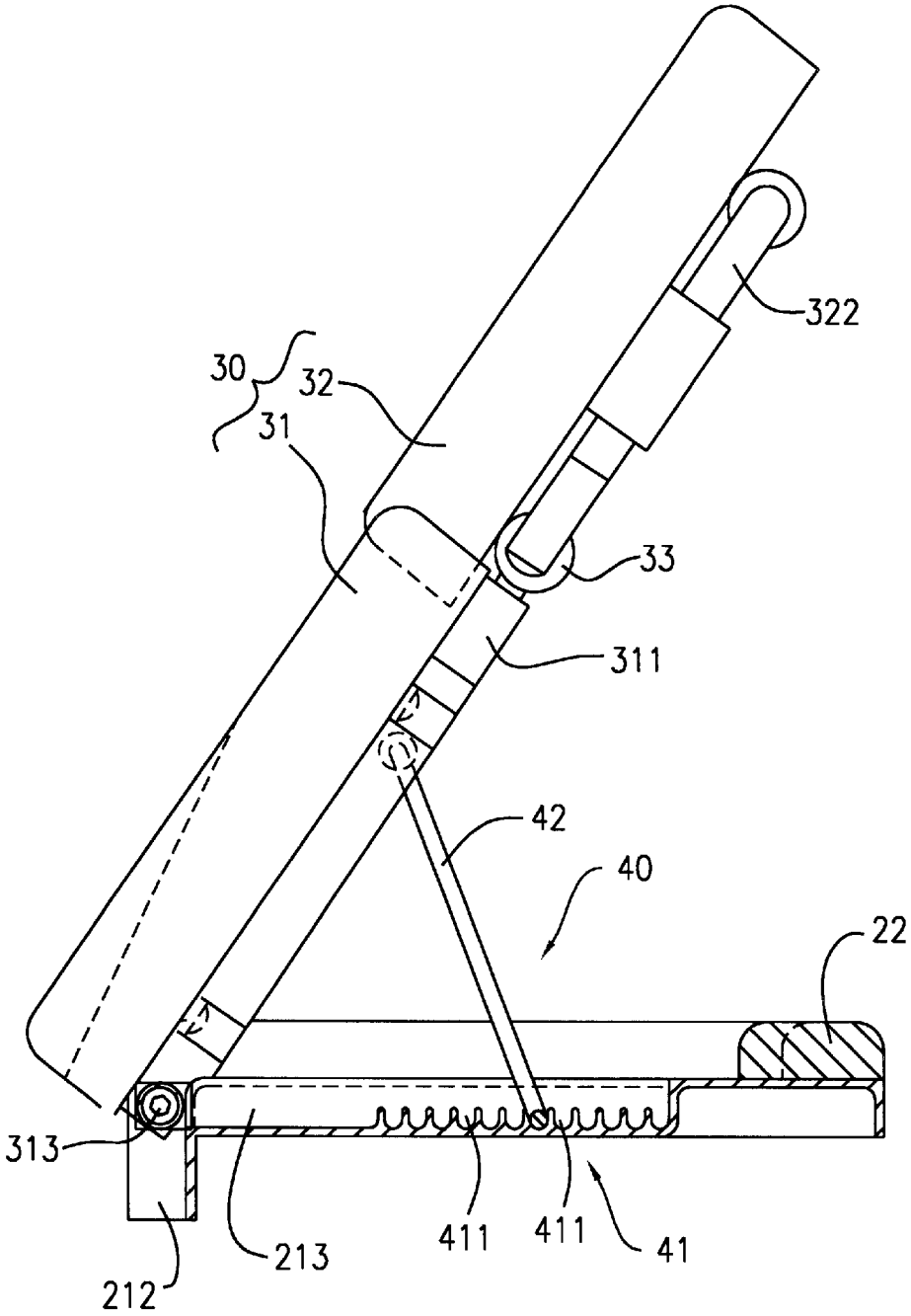
FIG. 4 is a side view partially in section of the present invention showing the angle-adjustable tabletop personal support apparatus set in the extended state.
Figure 5:
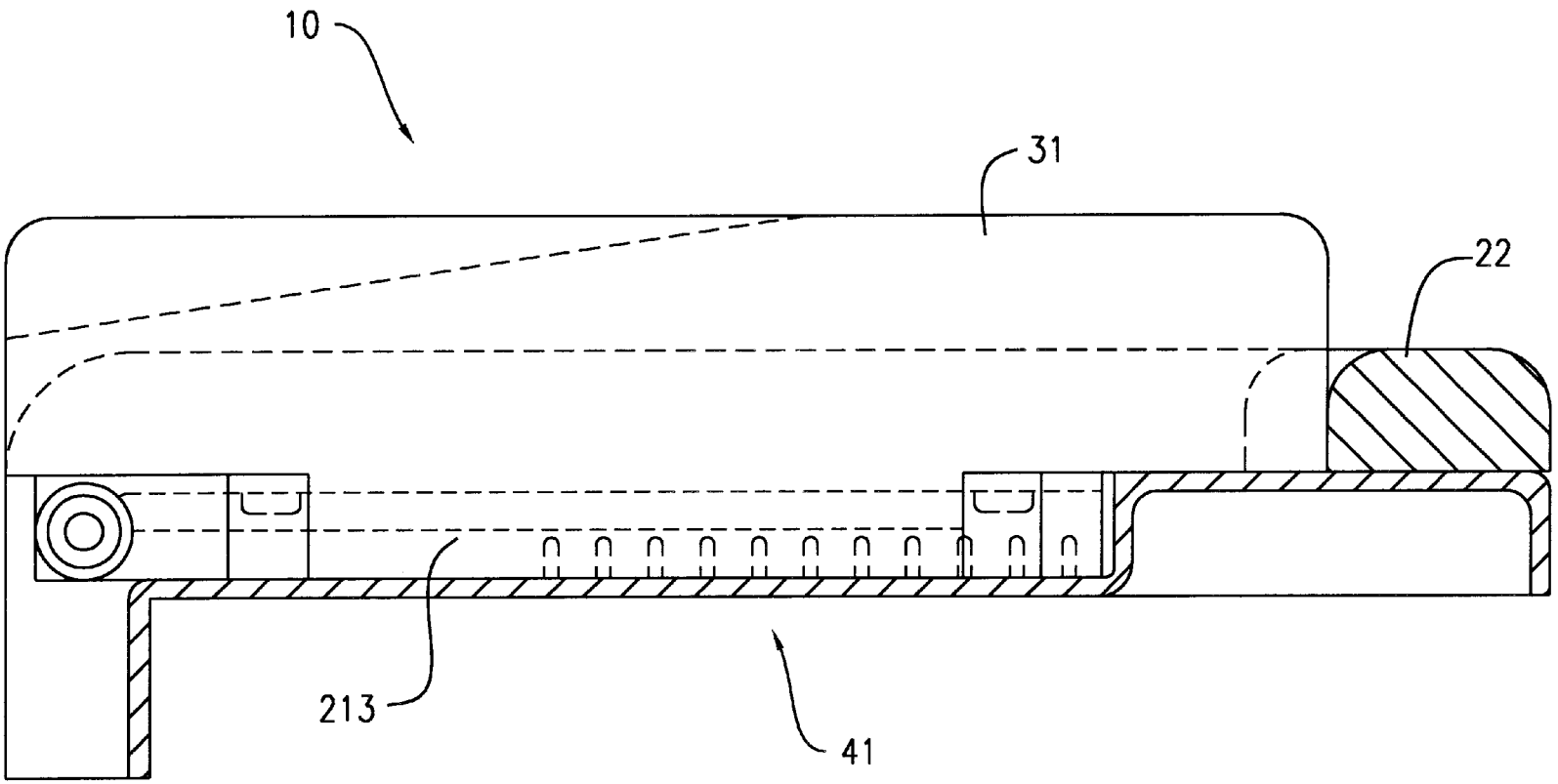
FIG. 5 is a side view partially in section of the present invention showing the angle-adjustable tabletop personal support apparatus set in the collapsed state.

Referring to FIGS. 3–5, the supporting mattress unit 30 comprises a chest mattress 31 and a head mattress 32. The chest mattress 31 and the head mattress 32 are each stuffed with molded foam or any of a variety of soft materials. The chest mattress 31 comprises two parallel frame rods 311 fixedly secured to the back side thereof. The frame rods 311 each have one end pivotably mounted to the base frame 21 of the positioning base 20 at 313 such that the chest mattress 31 can be pivoted in and out of the recessed receiving portion 213 of the positioning base 20. The other side of the chest mattress 31, namely the front side, curves inwardly (see also FIG. 1) for the resting thereon of the user's chest. The head mattress 32 is shaped like a split ring defining a substantially T-shaped opening 321 for the resting therein of the user's head, and comprises a U-shaped frame rod 322 fixedly secured to the back side of the head mattress 32. The frame rod 322 is pivotably mounted to the frame rods 311 of the chest mattress 31. Two quick release locks 33 are adapted to secure the U-shaped frame rod 322 to the frame rods 311 of the chest mattress 31, for enabling the head mattress 32 to be pivoted relative to the chest mattress 31 within a limited range and locked in the desired angular position relative to the chest mattress 31.

Referring to FIGS. 4 and 2A, the angle adjustment unit 40 comprises a locating frame 41 and a support rod 42. The locating frame 41 is fixedly secured to the base frame 21 of the positioning base 20 within the recessed receiving portion 213, and has a plurality of parallel locating grooves 411 for the positioning of the support rod 42. The support rod 42 is adapted to support the chest mattress 31 in one of a series of tilted positions, having a first end pivotably secured to the parallel frame rods 311 of the chest mattress 31 and a free end adapted for selective positioning in a selected one of the locating grooves 411 of the locating frame 41.

The use of the angle-adjustable tabletop personal support apparatus 10 is outlined hereinafter. When in use, the positioning base 20 of the angle-adjustable tabletop personal support apparatus 10 is placed on the top of the table 60 (FIG. 1) with the downwardly protruding positioning portions 212 of the base frame 21 of the positioning base 20 stopped against one peripheral edge 611 of the top of the table. The supporting mattress unit 30 is then lifted from the positioning base 20, and then the support rod 42 is positioned in a selected one of the locating grooves 411 of the locating frame 41 to support the chest mattress 31 in the desired tilted position. The quick release locks 33 are then respectively locked after the head mattress 32 has been adjusted to the desired angle relative to the chest mattress 31. When having an upper body massage or taking a nap, the user rests his/her head on the head mattress 32, chest on the chest mattress 31, and hands on the bearing mattress 22. When resting the head on the head mattress 32, the eyes, nose, and mouth are positioned in the T-shaped opening 321. Accordingly, the user does not feel uncomfortable, and the muscles of the hands as well as of the body can be fully relaxed. Because the downwardly protruding positioning portions 212 of the base frame 21 of the positioning base 20 are stopped at one side edge of the top of the table, the angle-adjustable tabletop personal support apparatus 10 does not slip on the top of the table.

When not in use, the quick-release locks 33 are loosened, and the chest mattress 31 is disconnected from the head mattress 32. The support rod 42 is then disengaged from the locating grooves 411 of the locating frame 41 and received with the chest mattress 31 in the recessed receiving portion 213 of the base frame 21 of the positioning base 20, as shown in FIG. 5.

As indicated above, the present invention provides an angle-adjustable tabletop personal support apparatus, which provides numerous advantages as indicated below.

The angle-adjustable tabletop personal support apparatus is comfortable in use. Because the user can rest his/her hands, head and chest on the soft bearing mattress, the head mattress and the chest mattress, respectively, with the eyes, nose and mouth received in the T-shaped opening of the head mattress, the user can be fully relaxed when having an upper body massage or taking a nap.

The angle-adjustable tabletop personal support apparatus is space saving. When in use, the angle-adjustable tabletop personal support apparatus can be directly put on the top of a table or desk. When not in use, the head mattress can be detached from the chest mattress, enabling the chest mattress to be received with the support rod in the recessed receiving portion of the positioning base to minimize space occupation in this collapsed state.

The angle-adjustable tabletop personal support apparatus fits different users because the head mattress can be adjusted to one of a series of angular positions relative to the chest mattress and the chest mattress can be adjusted to one of a series of angular positions relative to the positioning base.

Because the angle-adjustable tabletop personal support apparatus has a simple structure, its manufacturing cost is low.

The angle-adjustable tabletop personal support apparatus is easy to use. The user can quickly set the angle-adjustable tabletop personal support apparatus to the desired working position for use.

The angle-adjustable tabletop personal support apparatus is portable; a disabled person can use the angle-adjustable tabletop personal support apparatus on the table without leaving the wheelchair when taking a nap or having an upper body massage.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An angle-adjustable tabletop personal support apparatus comprising:

a positioning base for positioning on the top of a table and including a base frame and a soft bearing mattress mounted on said base frame;

a chest supporting mattress unit adapted to support the chest of a user and including a chest mattress for the support of a user's chest, said chest mattress having two parallel frame rods fixedly secured to a back side thereof and respectively pivotably secured to said positioning base, and a soft front side curved inwardly;

a head supporting mattress unit including a head mattress for the support of a user's head, and means adapted to pivotably and removably secure said head mattress to said chest supporting mattress unit for enabling said head mattress either to be adjusted to a desired angular position relative to said chest mattress or to be separated from said chest mattress; and an angle adjustment unit provided between said positioning base and said chest supporting mattress unit and adapted to support said chest supporting mattress unit on said positioning base in a tilted position at a selected angle therebetween;

wherein said soft bearing mattress and said base frame of said positioning base together define a recessed receiving portion adapted to receive said chest supporting mattress unit after said head mattress is separated therefrom.

2. The angle-adjustable tabletop personal support apparatus as claimed in claim 1 wherein said positioning base comprises at least one downwardly protruding positioning portion located in proximity to where said chest supporting mattress unit is pivoted to said positioning base and adapted to engage a peripheral edge of the top of the table on which said positioning base is placed;

whereby when a user rests his/her chest on said chest supporting mattress unit with the downwardly protruding positioning portion engaging the peripheral edge of the tabletop, the support apparatus is prevented from moving along the tabletop away from the peripheral edge.

3. The angle-adjustable tabletop personal support apparatus as claimed in claim 1 wherein said head mattress has a T-shaped opening adapted to receive the eyes, the nose, and the mouth of a user when the user is resting his/her head on said head mattress.

4. The angle-adjustable tabletop personal support apparatus as claimed in claim 1 wherein said angle adjustment unit comprises a locating frame fixedly secured to said positioning base, and a support rod adapted to support said chest supporting mattress unit on said positioning base in a desired angular position relative to said positioning base, said support rod having a first end pivotably secured to said chest supporting mattress unit and a free end adapted for positioning on said locating frame.

5. The angle-adjustable tabletop personal support apparatus as claimed in claim 4 wherein said locating frame comprises a plurality of locating grooves adapted to selectively receive the free end of said support rod for enabling said support rod to support said chest supporting mattress unit on said positioning base in a selected angular position relative to said positioning base.

* * * * *